United States Patent [19]

Brormann

[11] Patent Number: 5,054,275

[45] Date of Patent: Oct. 8, 1991

[54] APPARATUS FOR SUPPLYING VALVED SACKS TO A FILLING NOZZLE

[75] Inventor: Hubert Brormann, Oelde, Fed. Rep. of Germany

[73] Assignee: Firma Haver & Boecker, Oelde, Fed. Rep. of Germany

[21] Appl. No.: 540,135

[22] Filed: Jun. 19, 1990

[30] Foreign Application Priority Data

Jun. 23, 1989 [DE] Fed. Rep. of Germany ..... 3920582

[51] Int. Cl.[5] ..... B65B 43/16; B65B 43/46

[52] U.S. Cl. ..... 53/573; 141/68; 141/166

[58] Field of Search ..... 53/570, 571, 573; 141/68, 166, 315

[56] References Cited

U.S. PATENT DOCUMENTS

| | | | |
|---|---|---|---|
| 3,053,027 | 9/1962 | Frost | 53/571 |
| 3,423,903 | 1/1969 | Miller, Jr. | 53/571 |
| 3,522,691 | 8/1970 | Adcox . | |
| 3,691,715 | 9/1972 | Kelly et al. | 53/571 X |
| 3,715,858 | 2/1973 | Durant et al. | 53/573 |
| 3,952,479 | 4/1976 | Achelpohl | 53/570 |
| 4,128,116 | 12/1978 | Uthoff et al. | 141/68 X |
| 4,179,868 | 12/1979 | Raiteri | 53/571 |
| 4,664,162 | 5/1987 | Durant | 53/573 X |
| 4,711,070 | 12/1987 | Massa et al. | 53/573 |

FOREIGN PATENT DOCUMENTS

| | | |
|---|---|---|
| 0928930 | 6/1955 | Fed. Rep. of Germany . |
| 3148195 | 6/1983 | Fed. Rep. of Germany . |

*Primary Examiner*—Robert L. Spruill
*Assistant Examiner*—Daniel B. Moon
*Attorney, Agent, or Firm*—Laubscher Presta & Laubscher

[57] ABSTRACT

Apparatus for supplying valved sacks or bags to filling nozzles is disclosed, including a first conveyor for transporting a sack to a waiting position spaced from the filling nozzle a distance at least equal to the width of the sack, and a second conveyor for transporting the sack in a suspended valve-open condition to the filling nozzle. A releasable gripping device associated with the second conveyor engages the sack adjacent the bottom of the valve means, thereby to open the same, which gripping device includes a pair of spaced opposed sheet metal plates.

7 Claims, 6 Drawing Sheets

APPARATUS FOR SUPPLYING VALVED SACKS TO A FILLING NOZZLE

BRIEF DESCRIPTION OF THE PRIOR ART

This invention relates to an apparatus for supplying to the nozzle of a serial filling machine a sack or bag of the cross bottom type having a filling valve means. An example of such a bag is shown by the German patent No. 928,930.

Suitable devices for the suspended transport of sacks to be filled from a separating station to a filling nozzle are known in different embodiments. The German patent No. 31 48 195 shows a device which is designed for slipping cross bottom valve type sacks onto the fill pipes of rotating filling machines. The slip-on device is designed in such a manner that only the space required by the mounted valve sacks is maintained unobstructed. The mounting of the sacks must be seen in the context of unlocking. In addition, as shown by U.S. Pat. No. 3,522,691, it is also known to provide devices having a gripper that can be traversed along a horizontal guide rail and that seizes the valve bottom of the respective sack in the separating station and then transports it to the separating station and to the filling pipe.

The aforementioned two embodiments have a relatively long path over which the valve sack to be filled must be transported by means of the conveying means of the device. The result is the maximum possible output of the slip-on device. This output is adequate for rotating filling machines since the slip-on device is mounted at a fixed location, whereas with serial packing machines the traversing is transverse relative to the direction in which the valve sacks are conveyed in order to load the filing pipes. Then the targeted output is no longer adequate.

Frequently there is the requirement that the valves of the sacks must be sealed in a dust-tight manner by heat sealing or adhesive bonding. In the case of rotating filling machines, the filled sacks are always released at the same point so that they can be transported without any problem into a subsequent sealing machine. However, with serial packing machines it is necessary that a sealing unit be assigned to each individual packing machine. Then, following release from the fill pipes, the filled sacks fall into the respective sealing device. If the serial packing machine is equipped with more than two packing machines or fill pipes, the sealing devices assigned to the outer packing machines are offset outwardly in such a manner that they do stand in the way of the slip-on devices. However, the sealing devices standing between the outer sealing devices prevent the traversibility of the slip-on device.

The present invention is based on the problem of further developing a device of the aforementioned kind in such a manner that the necessary output for an application with serial packing machines with several fill pipes is achieved and that it can also be used when such a serial packing machine is to be equipped or retrofitted with a number of valve sealing devices that corresponds to the number of filling pipes.

SUMMARY OF THE INVENTION

The present invention relates to an improved apparatus for transporting valved sacks or bags to filling nozzles, characterized by the provision of first conveyor means for transporting each sack from a source thereof to a waiting position spaced from the fill nozzle a distance at least as great as the width of the sack, and second conveyor means for transporting the sack—when in a suspended valve-open condition—from the waiting position to the slipped-on filling position relative to the filling nozzle.

According to a more specific object of the invention, since the transport means for conveying the valve sacks to be filled is formed at this stage by two conveyors, the entire distance is now divided into two sections so that the output can be significantly increased due to the shorter distances over which the sacks must be transported by one of the conveyors. Since the sacks to be slipped on are transported by the first conveyor only to the point that is spaced—at least as wide as the sack widths—between the free ends of the fill pipes and the front edges of the sack, whereby a space is provided for the sealing device in connection with the second conveyor. As soon as a valve sack to be slipped on is taken over by the second conveyor, a valve sack is transported by means of the first conveyor from the separating station as far as the waiting station, where it stays until this sack is recalled from the waiting position by a free fill pipe by means of a corresponding signal.

According to a further object of the invention, the second conveyor means engages the bottom of the valve means of the sack, so that no other means are necessary to hold the sack. Furthermore, these gripper means cause the valve to remain open. Expediently, an endless chain or belt drive is provided that is arranged above the traversing plane of the sacks and that can be driven by reversible drive means used as the drive for the gripper. This design results in an especially small number of required components. In addition, the components are sturdy and reliable. The gripper means is especially simple since it is formed in essence by two angular sheet-metal holders, wherein one sheet metal holder, preferably however, both, is pivoted around horizontal axis. When the gripper means are closed, they describe a square or an approximate square due to the angular shape of the sheet metal holders so that the valve bottom of a cross bottom valve sack is deformed in such a manner that the valve that is already opened in the separating device does not close again. The pivotability permits the valve sack to be taken over in the waiting position without any problems.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
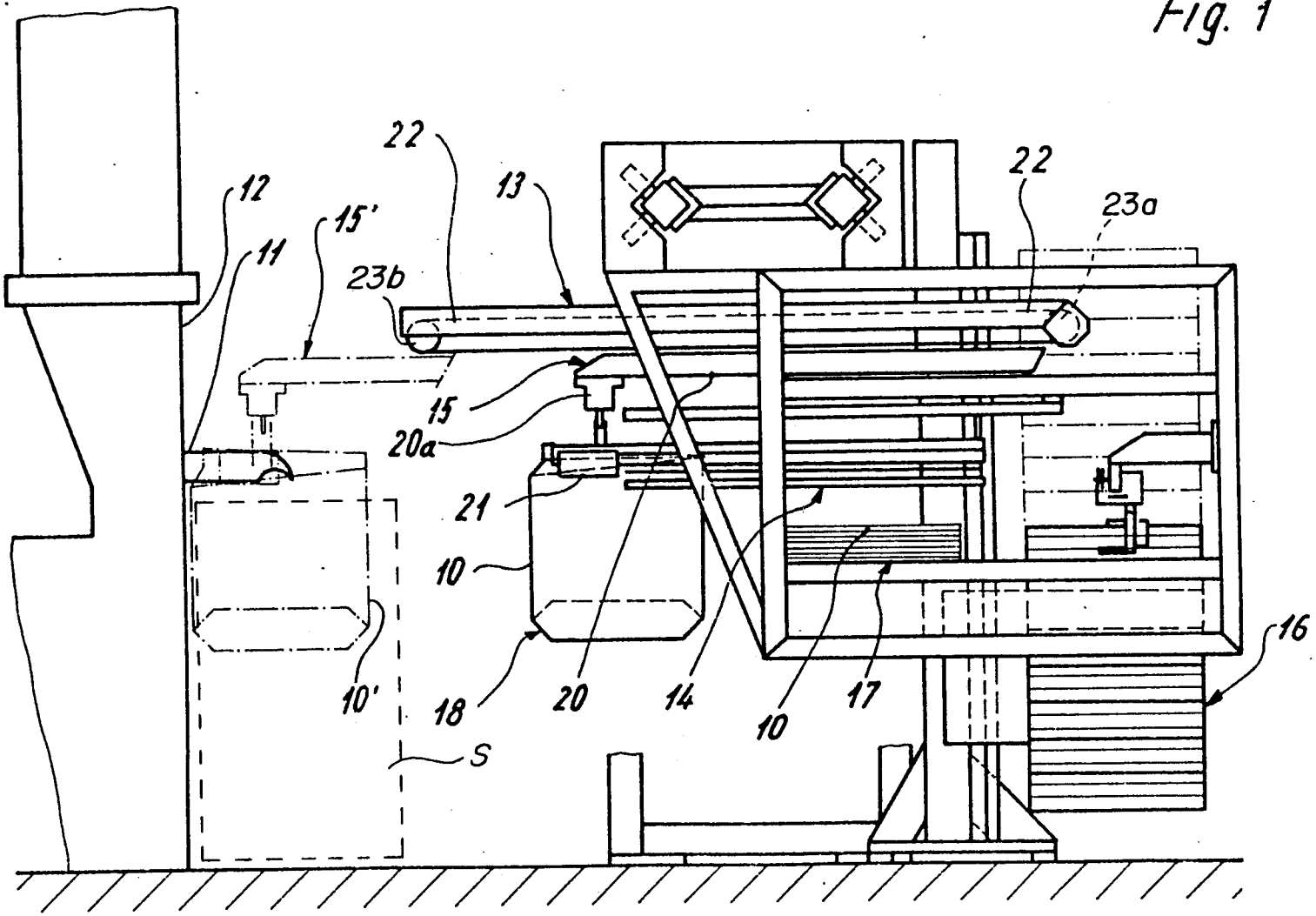
FIG. 1 is an elevational view of the valved sack filling apparatus of the present invention.

The slip-on device shown in the figures for slipping inverted cross or block bottom valved sacks or bags 10—formed, for example, of paper or a suitable synthetic plastic material—on the fill nozzle or pipe 11 of a serial packing machine 12 comprises transport means 13 that includes a pair of linear conveyors 14, 15 that are operable in series as will be explained in greater detail below. More particularly, the device comprises a magazine 16 that is spaced from the serial packing machine 12 and that is a box magazine in the present embodiment. A stack of sacks is brought from the magazine 16 into the separating station 17 by conventional handling means that need not be explained in detail. The cross bottom valve sacks 10 are separated there by suction means which are pivoted around a horizontal axis (not shown) and which touch down on the bottom of the valve means of the sacks 10, whereby the bags are placed in an inverted suspended position. During this process the valve means opens (FIG. 7), and the bottom portion of the valve means is shaped in such a manner that the valve means is maintained open by means of pivotally mounted support plates 21 carried by a guide rail and which engage the bottom portion of the valve means. The first conveyor means 14 comprising an endless belt drive 33 (FIG. 4) and pivotally supported pressure rollers 34 grip the sack, for example, below the valve bottom portion of the inverted sack in order to transport the valved sack from the separating station 17 into the waiting position 18, which is marked by the cross bottom valve sack 10 shown in solid lines. Then the second conveyor 15 following the first conveyor 14 takes over the inverted valve sack 10 and transports it following its assignment to a free fill pipe 11. The left end position of the second conveyor 15 and the valve sack 10 are shown with dashed-dotted lines and denoted by the reference numerals 15' and 10' respectively. It is apparent from. FIG. 1 that, following separation, each cross bottom valve sack 10 is always further conveyed in the same direction without any sideways rerouting or lifting or lowering. It follows from FIG. 1 that the distance between the free end of the fill pipe 11 and the advancing, vertical edge of the block bottom valve sack 10 in the illustrated embodiment is somewhat larger than the sack width. In addition, the figure clearly shows that the space from the floor to the fill pipe in the region of motion of the second conveyor 15 is free so that a sack sealing machine S can be installed therein.

Figure 3:
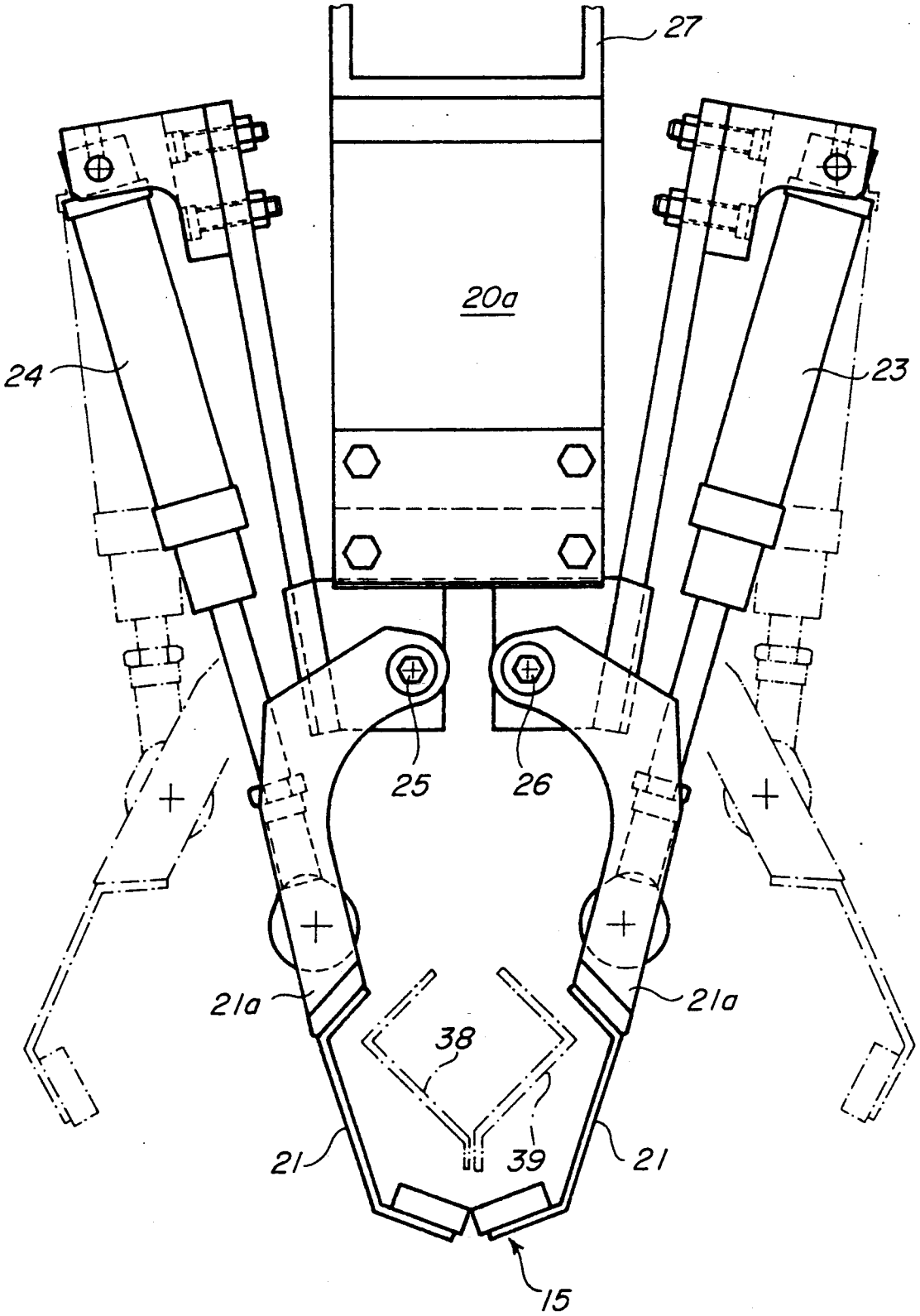
FIG. 3 is a detailed view taken along line 3—3 of FIG. 1.

The second conveyor 15 has a guide rail 20 (FIGS. 1 and 6) that can be traversed in the horizontal direction and that lies above the valve bottom of the block bottom valve sack 10. At the front and facing the fill pipe 11, a support **20*a* on which two sheet metal holders or sack gripping devices 21 are pivotally connected is fastened to the guide rail 20. The sheet metal holders 21 define gripping means that are angular in cross-section and define gripping means that embrace the valve bottom portion of the cross bottom valved sack 10. The sheet metal holders 21 are pivoted by a piston cylinder means 23 and 24, as shown in FIG. 3. To transport the valved sack 10 in the waiting position, said sheet metal holders are pivoted towards one another into the transport position so that the block bottom valve sack 10 is held. After slipping on the fill pipe 11**, they are opened again and returned into the starting position.

The guide rail 20 is coupled via a carrier (not illustrated) with an endless drive belt 22 which lies above the guide rail 20. The drive and idler pulleys **23*a*, 23*b* of the drive belt 22 rotate around horizontal axes. The gear belt drive 22 is driven by a drive whose direction of rotation is reversible in a manner that is not explained in detail. Instead of a drive belt a chain drive could also be used. As soon as the cross bottom valved sack 10 to be slipped on is taken over by the sheet metal holders 21 and released by the first conveyor 14, the next sack is separated from the stack and transported into the waiting position 18**.

Figure 2:
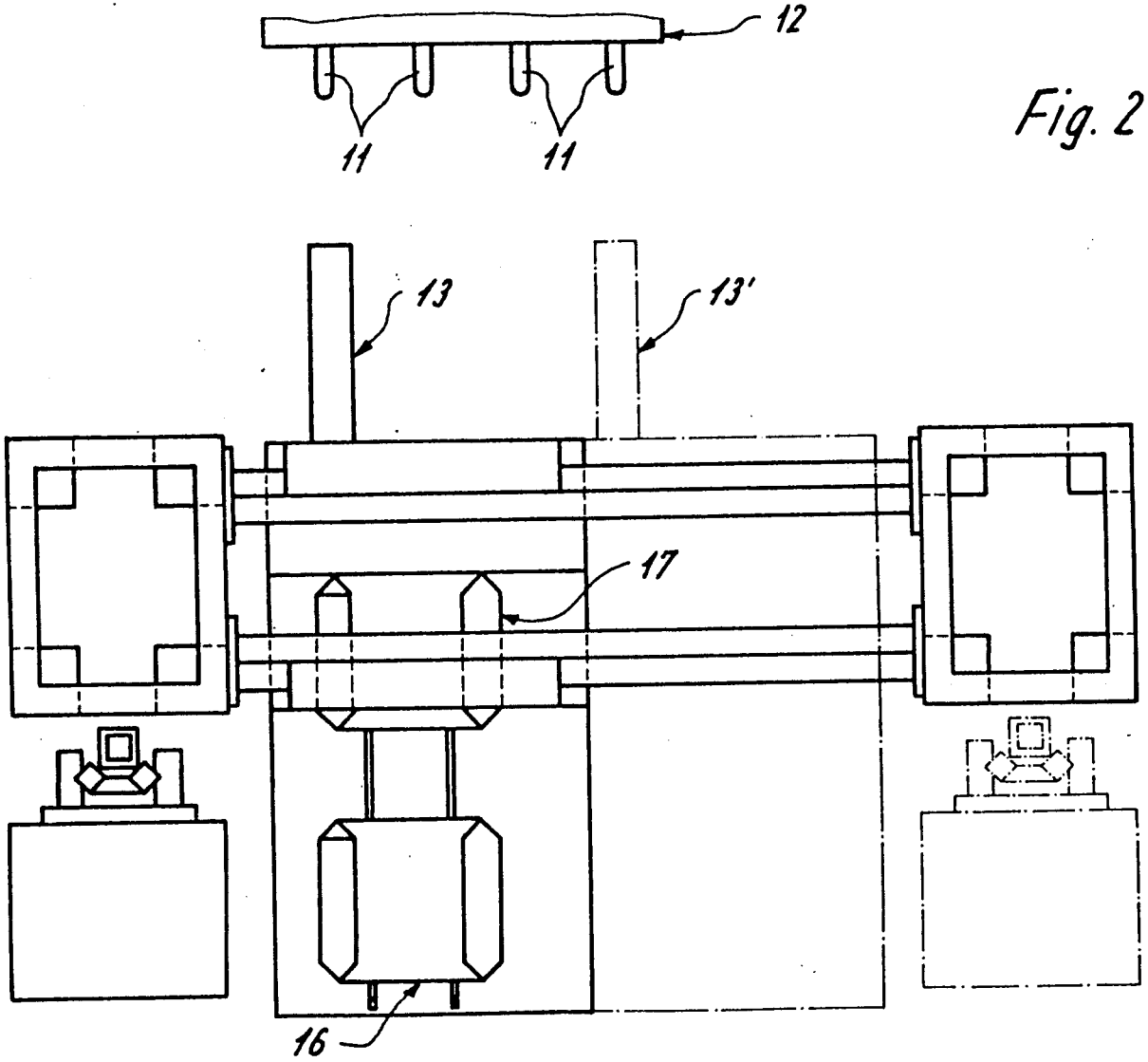
FIG. 2 is a top plan view rotated through 90°, of the apparatus of FIG. 1.

As shown in FIG. 2, the entire slip-on or sack mounting device can be traversed from a left end position into a right end position. The left end position of the transport device 13 is shown with solid lines. The right end position is shown by dashed-dotted lines, this position of the transport device 13 being indicated by the reference numeral 13'. The individual fill nozzles 11 are not loaded according to a pre-determined scheme but rather through recall by a free fill pipe. The control for the traversibility of the slip-on device transversely to the transport direction of the sacks and the control of the transport device 13 is not described for the sake of simplicity. The valved bags are preferably formed of paper that is adhesively sealable, or of a synthetic plastic material that is heat sealable, or the like.

Figure 4:
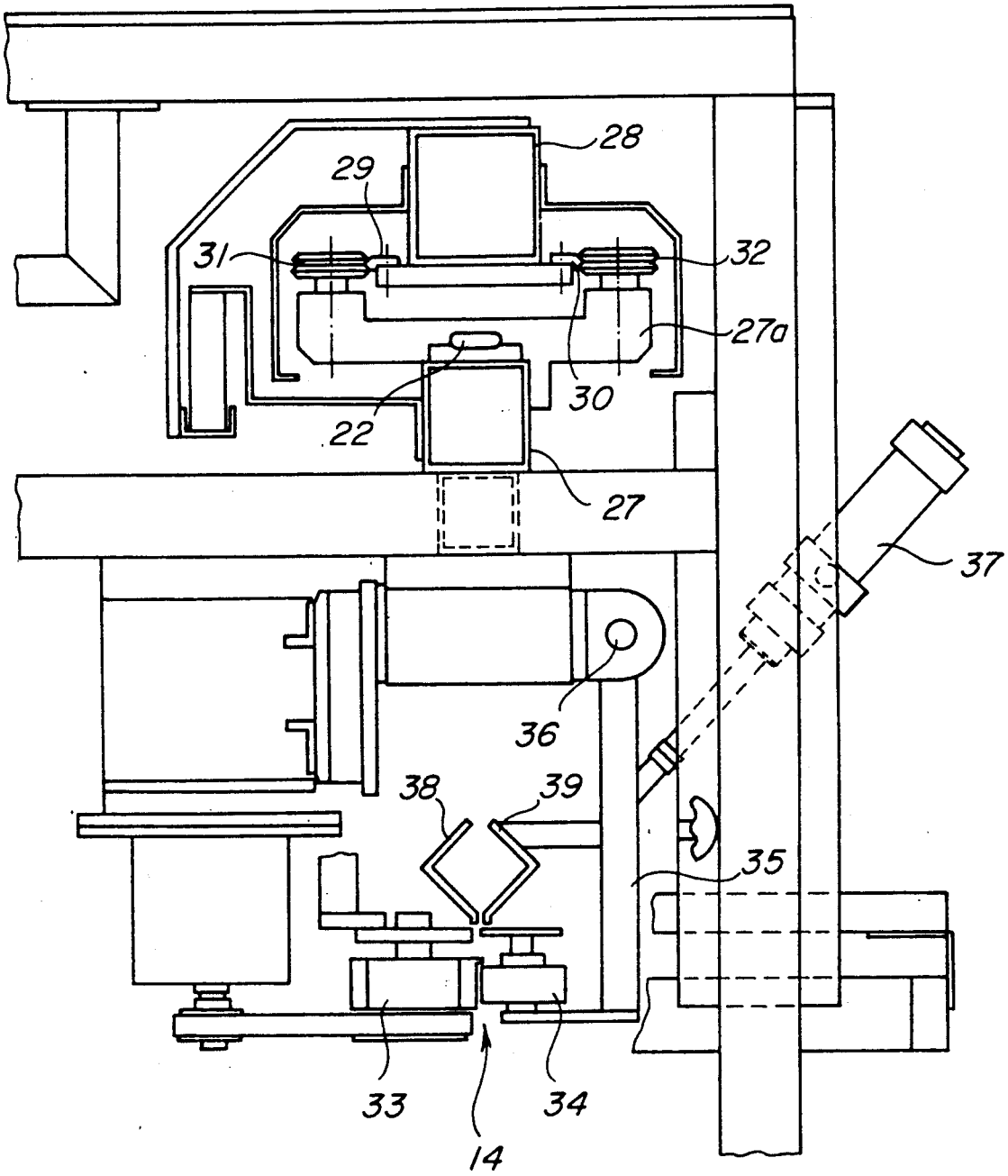
FIG. 4 is a sectional view taken along line 4—4 of FIG. 1.
Figures 5, 7:
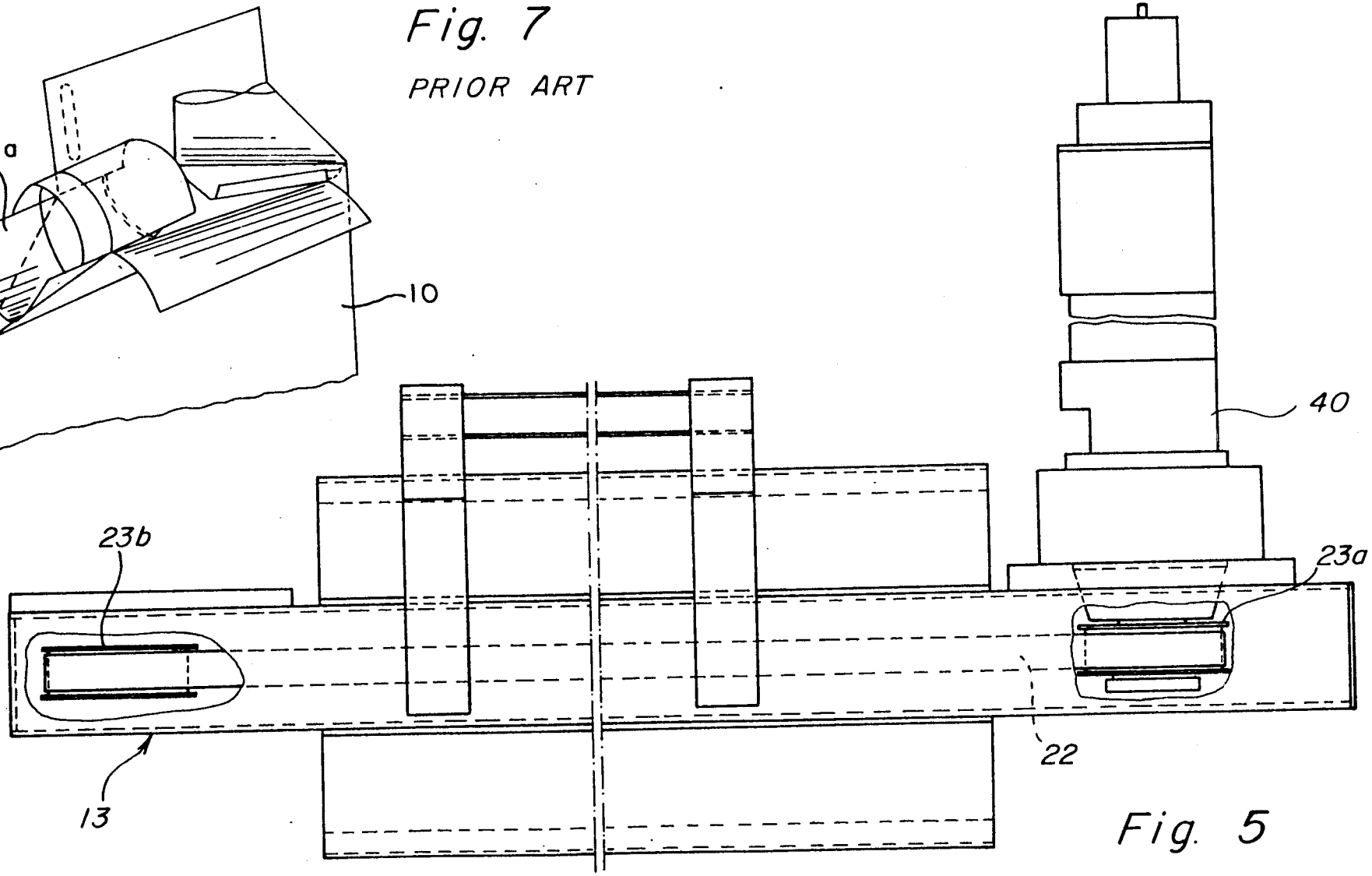
Fig. 7 PRIOR ART
FIG. 5 is a detailed top plan view of the drive means for the second conveyor.
FIG. 7 is a perspective view of the bottom of the inverted sack when in an open filling condition.
Figure 6:
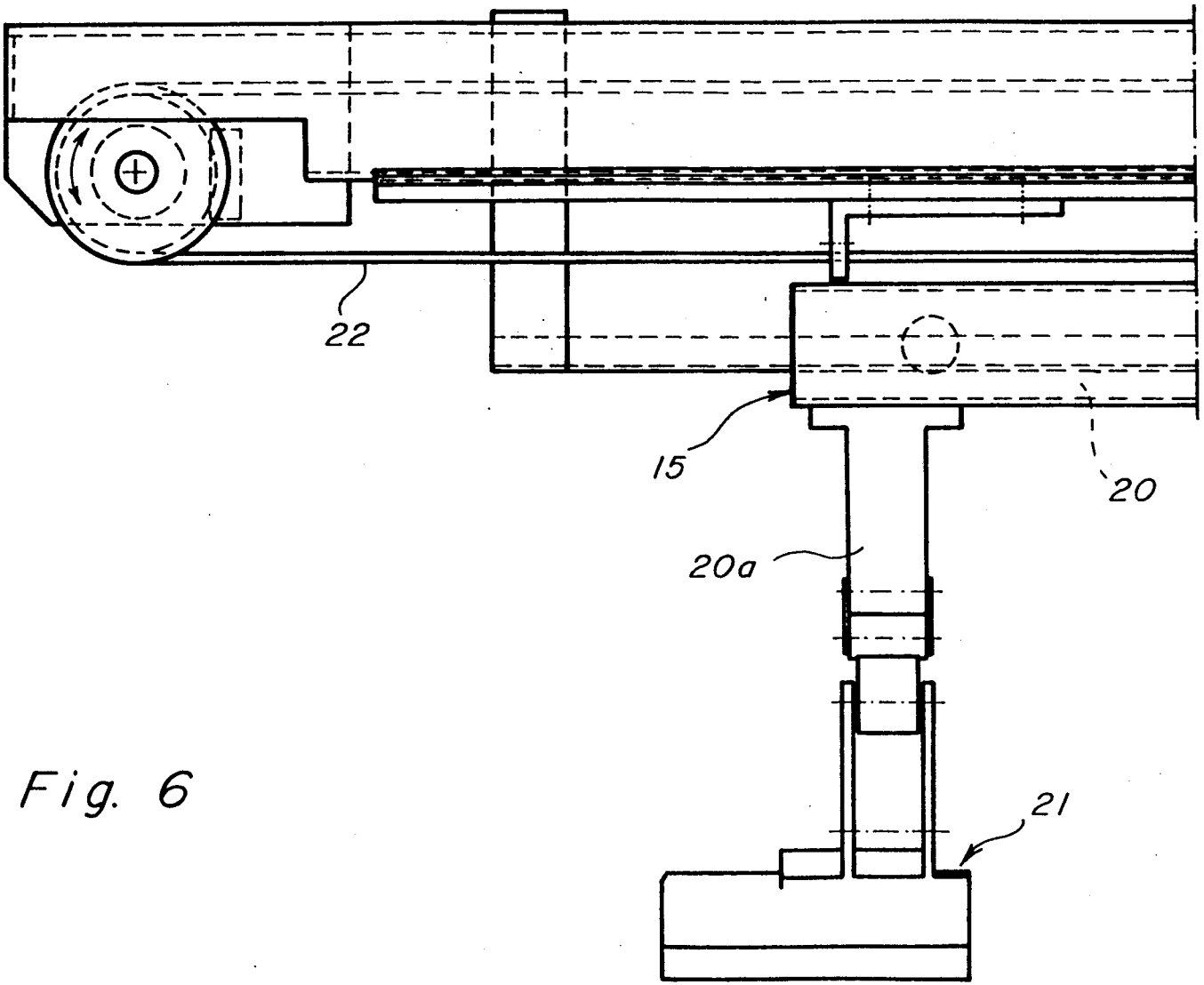
FIG. 6 is a detailed view illustrating the connection between the second conveyor and the carrier for the sack engaging means.

Referring now to FIGS. 3, 4 and 6, the sack gripping plates 21 of the second conveyor means 15 are mounted on arms **21*a* that are pivotally connected with support 20*a* for pivotal movement about horizontal pivot axes 25, 26, the arms being operable by piston and cylinder motor means 23 and 24, respectively, between the sack-gripping and sack-released positions shown in the solid and phantom lines, respectively. The endless drive conveyor 22 mounted on drive pulley 23*a* and idler pulley 23*b* is driven by the reversible motor means 40 to transport support member 20*a* and gripper plates 21 between the waiting position 18 shown in solid lines in FIG. 1** to the sack filling position shown in phantom.

As shown in FIG. 4, the first conveyor means 14 includes sack support plates 38 and 39 which engage and support the inverted sack. As is known in the art, owing to the angular configuration of the sack support plates, they engage the bottom portion of the inverted sack to open the valve means **10*a* to the filling condition shown in FIG. 7. Support plate 39 is carried by a pivot arm 35 which is pivotally connected with the frame for pivotal movement about horizontal pivot axis 36 by piston-cylinder motor means 37. Rotatably carried by the free end of pivot arm 35 is an idler roller 34 that is operable to engage the portion of the inverted sack adjacent its bottom and to force the same into engagement with the endless belt transport means 33, whereby the sack is transported toward the waiting position 18 of FIG. 1**.

As also shown in FIG. 4, the channel 27 having a hollow rectangular cross-sectional configuration and from which the support **20*a* depends (as shown in FIG. 3) is suspended by parallel guide rails 29 and 30 and cooperating guide rollers 31 and 32, respectively, from the fixed channel member 28. Thus, the carriage defined by channel 27, channel support 27*a*, gripper support 20*a*, and gripper members 21 is driven by reversible motor 40 to displace a sack 10 between the waiting and filling positions shown in FIG. 1**.

While the preferred forms and embodiments have been illustrated and described, it is apparent that changes may be made in the invention without deviating from the inventive concepts set forth above.

What is claimed is:

1. In an apparatus for successively supplying to the filling nozzle (11) of a serial packaging machine (12) a block bottom sack (10) having valve means (10*a*) at one end thereof, said packaging machine including a source of valved sacks (16), separating means (17) for supplying a sack from said source, means for opening the valve means of said sack, transporting means for transporting the sack in a suspended inverted condition from the separating means to the filling nozzle, and valve sealing means (S) associated with said filling nozzle for sealing the valve means, the improvement wherein said transporting means comprises:

(a) first linear conveyor means (14) for linearly transporting said sack from said separating means to a waiting position (18) spaced from said filling nozzle a distance at least as great as the width of the sack, said first linear conveyor means including:

(1) support plate means (38,39) for engaging the top portion of the sack to support the sack in a valve-open condition, said support plate means being at the same height as, and arranged on the opposite side of said waiting position from, said filling nozzle; and (2) first endless conveyor means (33) arranged below and adjacent said support plate means for engaging opposed first side portions of the sack adjacent said sack top portion and for transporting the valve-open sack from said source toward said waiting position; and (b) second linear conveyor means (15) arranged colinearly of said first endless conveyor means for engaging said opposed first side portions of the sack and for conveying the sack to said filling nozzle.

2. Apparatus as defined in claim 1, wherein said second linear conveyor means includes releasable gripping means (21) for engaging said opposed first side portions of said sack adjacent said valve means.

3. Apparatus as defined in claim 2, wherein said second linear conveyor means further includes reversible second endless drive means (22) arranged above, and extending parallel with, said first endless conveyor means.

4. Apparatus as defined in claim 3, wherein said second endless drive means (22) include rotary drive and idler pulleys having horizontal axes, and further wherein said first endless conveyor means (33) includes rotary drive and idler pulleys having vertical axes.

5. Apparatus as defined in claim 2, wherein said gripping means includes a pair of spaced sheet metal members (21) at least one of which is mounted for pivotal movement about a horizontal pivot axis that is parallel with said first endless conveyor means.

6. Apparatus as defined in claim 5, wherein said second linear conveyor means further includes a horizontal guide rail (20) that is mounted for reciprocation toward and away from said filling nozzle, respectively, said guide rail being parallel with said first endless conveyor means.

7. Apparatus as defined in claim 6, wherein said guide rail (20) and said second endless drive means (22) are arranged above said first endless conveyor means.

* * * * *